United States Patent [19]

Jetter

[11] 4,426,157

[45] * Jan. 17, 1984

[54] CLOCK ALARM CONTROL SYSTEM EMPLOYING A PUSH BUTTON ALARM-DEACTIVATION SWITCH WHICH MUST BE HELD DEPRESSED FOR A TIME PERIOD

[76] Inventor: Milton W. Jetter, 201 I St., SW., Apt. 838, Washington, D.C. 20024

[ * ] Notice: The portion of the term of this patent subsequent to Feb. 16, 1999 has been disclaimed.

[21] Appl. No.: 343,735

[22] Filed: Jan. 29, 1982

[51] Int. Cl.[3] ..... G04C 21/00

[52] U.S. Cl. ..... 368/73; 368/49; 368/262

[58] Field of Search ..... 368/73, 72, 244, 257, 368/262, 94, 46, 47, 250, 249

[56] References Cited

U.S. PATENT DOCUMENTS

| | | | |
|---|---|---|---|
| 3,748,846 | 7/1973 | Kikuchi | 368/47 |
| 4,216,647 | 8/1980 | Hattori | 368/73 |
| 4,218,875 | 8/1980 | Rothman | 368/262 |
| 4,234,944 | 11/1980 | Komaki et al. | 368/72 |
| 4,246,651 | 1/1981 | Komatsu et al. | 368/73 |
| 4,316,273 | 2/1982 | Jetter | 368/262 |
| 4,352,170 | 9/1982 | Jetter | 368/262 |
| 4,352,171 | 9/1982 | Jetter | 368/262 |

*Primary Examiner*—Bernard Roskoski
*Attorney, Agent, or Firm*—Herman L. Gordon

[57] ABSTRACT

An alarm clock with an alarm system which can be deactivated by means of either a local or remote manually operated push button switch which must be held in a depressed condition for a predetermined period of time in order to effectively deactivate the clock alarm. Means is provided to adjust the length of required switch hold-down time. An indicator is provided for showing the completion of the required hold-down period. In the case of remote deactivation, wherein the user must walk to the location of the push button switch, a radio link is employed to couple the remotely located switch with the locally positioned clock alarm system and to provide the desired alarm deactivation. The completion of the hold down period is signalled either by visual indicating means or by audible sounding means. Failure to complete the required hold-down period causes the normal audible alarm signal to be turned back on, and a new switch hold-down cycle for the required preset time period must be commenced for deactivation of the alarm. Local/remote switching circuitry is provided to allow the user to select a preferred control location for terminating an alarm cycle. The system may comprise separable modules and may include a separable standard broadcast radio receiver module.

23 Claims, 7 Drawing Figures

REMOTE CONTROLLED MODULAR ALARM CLOCK RADIO

SOUND INDICATOR CIRCUIT

FLAG INDICATOR CIRCUIT

CLOCK ALARM CONTROL SYSTEM EMPLOYING A PUSH BUTTON ALARM-DEACTIVATION SWITCH WHICH MUST BE HELD DEPRESSED FOR A TIME PERIOD

FIELD OF THE INVENTION

This invention relates to clock alarm deactivation systems, and more particularly to a clock alarm control system of the type employing a push button switch which must be held depressed for a predetermined extended time period in order to effectively deactivate the associated clock alarm device.

BACKGROUND OF THE INVENTION

Alarm clocks have heretofore been provided with various types of deactivation mechanisms and devices for enabling a user to shut off the alarm after it has become activated. In the case of mechanical alarm clocks, manually operated stop devices have been employed. With electrically operated clocks, switch devices or various types of combined mechanical and electrical alarmdeactivation means have been employed. In practically all of the previously employed alarm deactivation devices, the user is not required to get out of bed, and the alarm clock is usually placed conveniently within reach so that when its alarm becomes activated it can be readily reached for deactivation by the user. This turns out to be a serious disadvantage, since the alarm can be deactivated before the awakened person is fully awake, and thus there is a great temptation to go back to sleep, since it takes some time for an awakened person's brain to reach a fully functioning state.

Various types of quasi-remote-controlled alarm deactivation devices have been proposed, such as by verbal command, by the use of bed switches controlled by the sleeper's weight, by photo-electric systems, by touch control, and the like. Most of these deactivation devices are unsatisfactory, as being excessively complicated, unreliable in operation, too expensive, and not effective to adequately awaken the user. Thus, these previously proposed devices do not require the individual to get out of bed, walk to a designated location, and delay return for a time sufficient to enable the individual to become fully awake by the time the process of deactivating the alarm is completed. The time factor and the walking factor are quite important, since walking increases the blood circulation and assists the person's brain to reach a fully functional condition by the time the alarm is deactivated, especially when reaching such a functional condition requires a degree of concentration.

Therefore, a large percentage of prior clock alarm systems fail in their underlying purpose in that individuals learn to defeat these systems without being fully awake, and become accustomed to routinely going back to sleep after turning off the alarm. For this reason there is a definite need for an alarm deactivation system requiring a behavior pattern which ensures that the individual becomes fully awake by the time the alarm is completely deactivated. There is also a need for making the required time for achieving deactivation adjustable in accordance with the particular waking characteristics of the individual.

SUMMARY OF THE INVENTION

The alarm clock control system of the present invention includes a clock with an alarm system which can be deactivated by means of either a local or remote turn-off device, such as a manual push button switch which must be held in a depressed condition for a predetermined extended period of time in order to effectively deactivate the clock alarm. An adjustable means is provided to establish the length of the required time period for manually holding the push button switch pressed down for deactivating the alarm. Indicating means is provided for showing the completion of the required hold-down period. In the case of remote deactivation, wherein the user must leave his bed and walk to the location of the push button switch, a radio link is employed to couple the remotely located switch with the locally positioned clock alarm system and to provide the desired alarm deactivation. The completion of the hold-down period may be signalled either by visual indicating means or by audible sounding means. The system may comprise separable modules, and may include a separable standard broadcast radio receiver module. A basic component of the system is a conventional alarm clock timepiece which provides an alarm starting signal at a preset time. The starting signal normally activates a control circuit which turns on a gated alarm circuit which energizes an alarm speaker to cause it to emit a continuous audible tone. To accomplish deactivation of the alarm and resetting of the associated control circuit, a push button switch must be manually held in a depressed condition for a presettable predetermined time, for example, between 1 and 15 seconds. Initial activation of the push button switch operates a timing circuit which starts the preset timing interval. This action also silences the audible alarm signal. At the end of the preset hold-down period an indicator is energized for approximately 5 seconds to notify the user that the required hold-down period has been completed. When this period has been completed, the alarm circuitry is reset to a standby condition. Failure to complete the required hold-down period causes the normal audible alarm signal to be turned back on, and a new switch hold-down cycle for the required preset time period must be commenced for deactivation of the alarm. Local/remote switching circuitry is provided to allow the user to select a preferred control location for terminating an alarm cycle.

Accordingly, a main object of the invention is to provide an improved clock alarm control system which overcomes the deficiencies and disadvantages of the previously employed clock alarm deactivation systems.

A further object of the invention is to provide an improved clock alarm control system wherein the control system can be used to require sufficient effort and concentration by the user when he attempts to deactivate the clock alarm to ensure that the user reaches a wakeful state as a result of the deactivation procedure.

A still further object of the invention is to provide an improved clock alarm system which has an alarm deactivation circuit arrangement which requires a special degree of effort and attention on the part of the user when he attempts to deactivate the alarm and which requires mental concentration by the user over a sufficient preset time period to produce wakefulness, the system including means providing a positive signal to the user when the required time period for the deactivation effort has been completed.

A still further object of the invention is to provide an improved clock alarm system which has an alarm deactivation arrangement having a wide range of versatility in usage in that it can be arranged either as a system requiring the user to leave his bed and walk to a relatively remote location to deactivate the alarm, or as a self-contained composite assembly allowing a local deactivation procedure, the deactivation procedure in each case requiring the user to exert a positive physical effort sustained over a preset period of time in order to accomplish the desired deactivation of the clock alarm, and providing a completion signal at the end of the preset time period.

A still further object of the invention is to provide an improved clock alarm deactivation system including remotely controlled deactivation circuitry and including optionally either a local or a remotely controlled deactivation station using a radio transmitter and a manual push button switch which must be depressed to mute the alarm and must be held continuously depressed for a preset time period in order to successfully complete alarm deactivation, and which includes means to signal the completion of said preset time period, and wherein if the push button switch is released prior to the expiration of the preset deactivation timing interval, the clock alarm will be resumed and a new turn-off time interval will be required to deactivate the alarm.

BRIEF DESCRIPTION OF THE DRAWINGS

Further objects and advantages of the invention will become apparent from the following description and claims, and from the accompanying drawings, wherein:

DETAILED DESCRIPTION OF A PREFERRED EMBODIMENT

Figure 1:
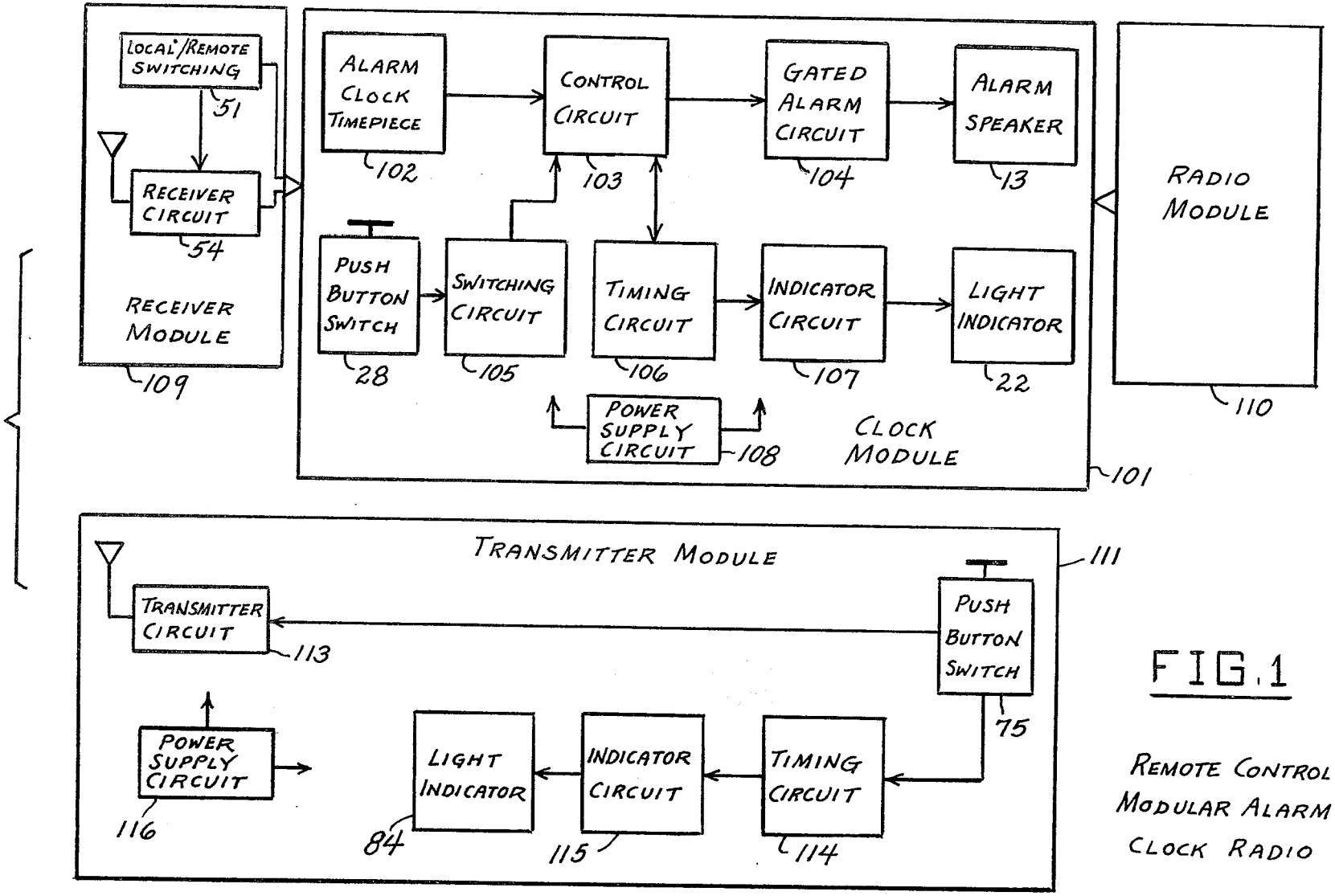
FIG. 1 is a block diagram of an improved remote-controlled modular alarm clock-radio system constructed in accordance with the present invention.

Referring to the drawings, FIG. 1 illustrates a remote controlled modular alarm clock radio containing an alarm control system according to the present invention. The clock module 101 is the foundation unit, which can function independently of the add-on modules consisting of plug-in receiver module 109 and its companion, remote transmitter module 111, as well as a standard broadcast radio module 110. The clock module 101, exclusive of the other modules cited, is a complete alarm clock timepiece containing an alarm control feature according to the present invention, and this will be described first.

Clock module 101 of FIG. 1 comprises a conventional alarm clock timepiece 102, which provides an alarm starting signal at a preset time. The starting signal activates control circuit 103, which turns on gated alarm circuit 104, causing a continuous audible tone to be emitted by alarm speaker 13. To accomplish turning off the alarm and resetting the control circuit, push button switch 28 must be held in a depressed state for a predetermined time (1 to 15 seconds) manually set in timing circuit 106 by the clock user. When push button switch 28 is depressed, switching circuit 105 is turned on, activating a gate device in control circuit 103 which causes timing circuit 106 to spontaneously start the preset timing interval. Also, a second gate device in control circuit 103 is concurrently used to interrupt the operation of the gated alarm circuit 104, consequently silencing the audible alarm signal.

As long as the push button of switch 28 is held in a depressed state, the preset timing interval will be permitted to expire, and then indicator circuit 107 turns on light indicator 22 for approximately 5 seconds. Light indicator 22 is provided to alert the user that the alarm cycle has been completed. When an alarm cycle is completed the alarm circuitry in clock module 101 is reset to a standby condition. If push button switch 28 is released prior to the expiration of the preset timing interval the audible alarm signal will turn back on and the preset timing interval wall reset to the zero time reference. When push button switch 28 is again pressed the alarm will be silenced and a new turn-off time interval initiated.

Power supply circuit 108 provides a positive direct current voltage (+D.C. v.) for the operation of all the circuits in the clock and receiver module.

The same function described above for push button switch 28 can be achieved remotely by the addition of the receiver and transmitter modules 109 and 111, respectively.

Receiver module 109 plugs into clock module 101. Receiver module 109 contains receiver circuit 54 and local/remote switching circuit 51. The local/remote switching circuit permits the user, by the use of a selector switch, to select a preferred control location for terminating an alarm cycle. After the user makes his selection it cannot be changed after an alarm cycle is started because the last state of the selector switch becomes latched by a circuit in the local/remote switching circuit 51. Also, local/remote switching circuit 51 enables receiver circuit 54.

Conditions are now established for the function of push button switch 28, described above, to be transferred to push button switch 75 of transmitter module 111. The timing circuit 114, indicator circuit 115, and indicator 84 of the transmitter module 111 are replicas of the similarly-entitled circuits used in clock module 101. The user presets the turn-off time interval of timing circuit 114 to correspond with the turn-off time interval selected for clock module 101. The transmitter module 111 may be located at a suitable distance from clock module 101, for example, in the bathroom or the kitchen, or at some other desired remote location at a substantial walking distance from the user's bed. When push button switch 75 is pressed it simultaneously initiates the timing circuit 114 and activates transmitter circuit 113. With push button switch 75 held in a depressed state, transmitter circuit 113 will send a continuous signal to receiver circuit 54 of receiver module 109. The receiver circuit will activate switching circuit 105 of clock module 101 and substitute for the use of push button switch 28. Also, the depressed push button switch 75 activates timing circuit 114 which, after the preset time expires, turns on indicator circuit 115 which then activates light indicator 84. The activated light indicator alerts the user that an alarm cycle has been successfully terminated from his remote location.

Transmitter module 111 is powered from its own internal power supply circuit 116. The power supply circuit furnishes a positive direct current voltage (+D.C.v.) to operate all circuits of transmitter module 111. In addition to employing the receiver and transmitter modules 109, 111, a standard broadcast radio module 110 is added to provide a composite clock/radio.

Referring to FIG. 1, radio module 110 is plugged into clock module 101. Radio module 110 has AM or AM/FM radio capability which can be turned on independently of the clock movement, or can be turned on automatically by the clock movement at the preset alarm time. Since the functional design features of radio module 110 are similar to conventional radio designs, they will not be described herein.

Figure 2A:
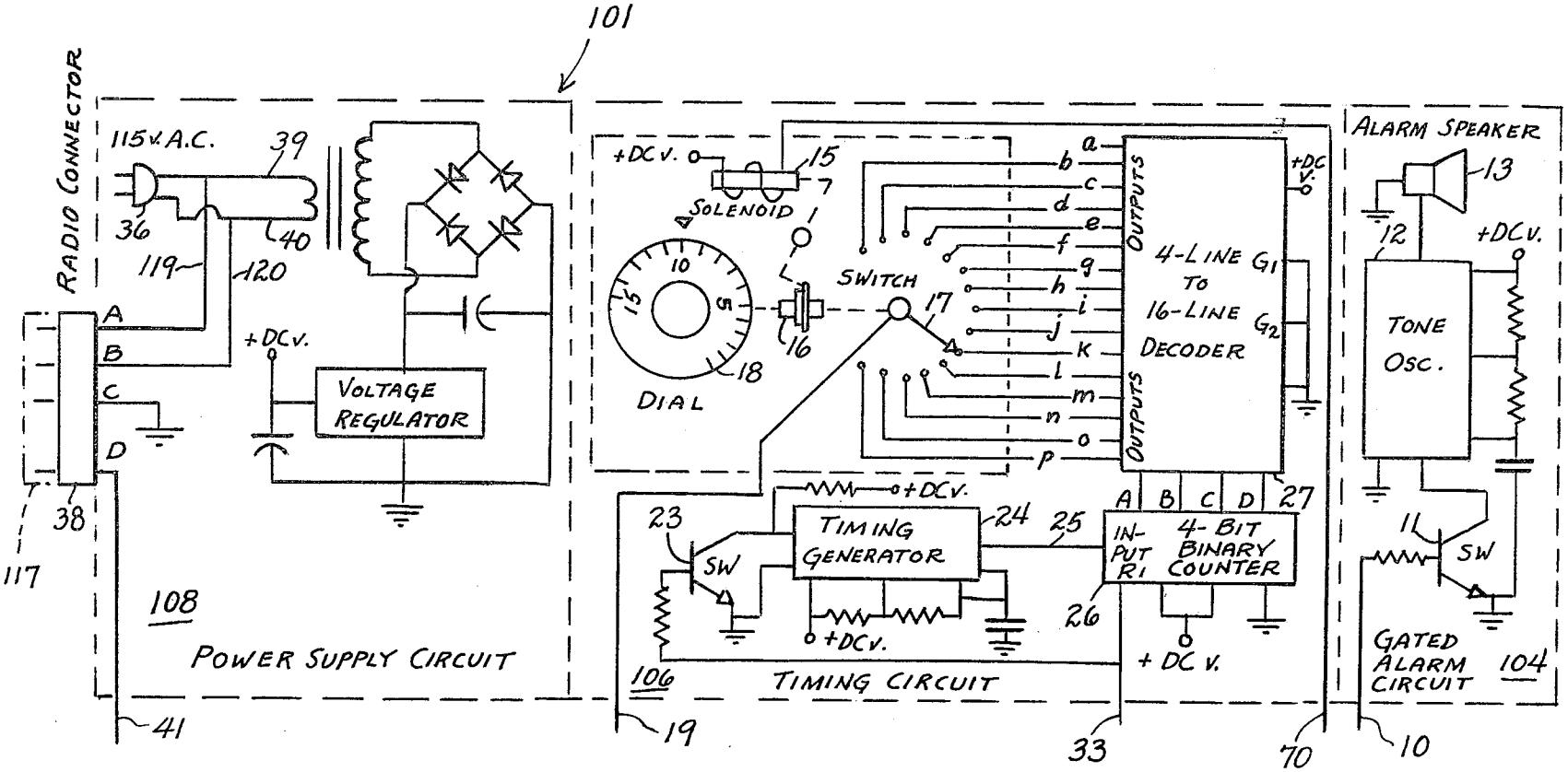
FIG. 2A is a detailed wiring diagram showing the power supply circuit, the timing circuit and the gated alarm circuit segments of the system of FIG. 1.
Figure 2B:
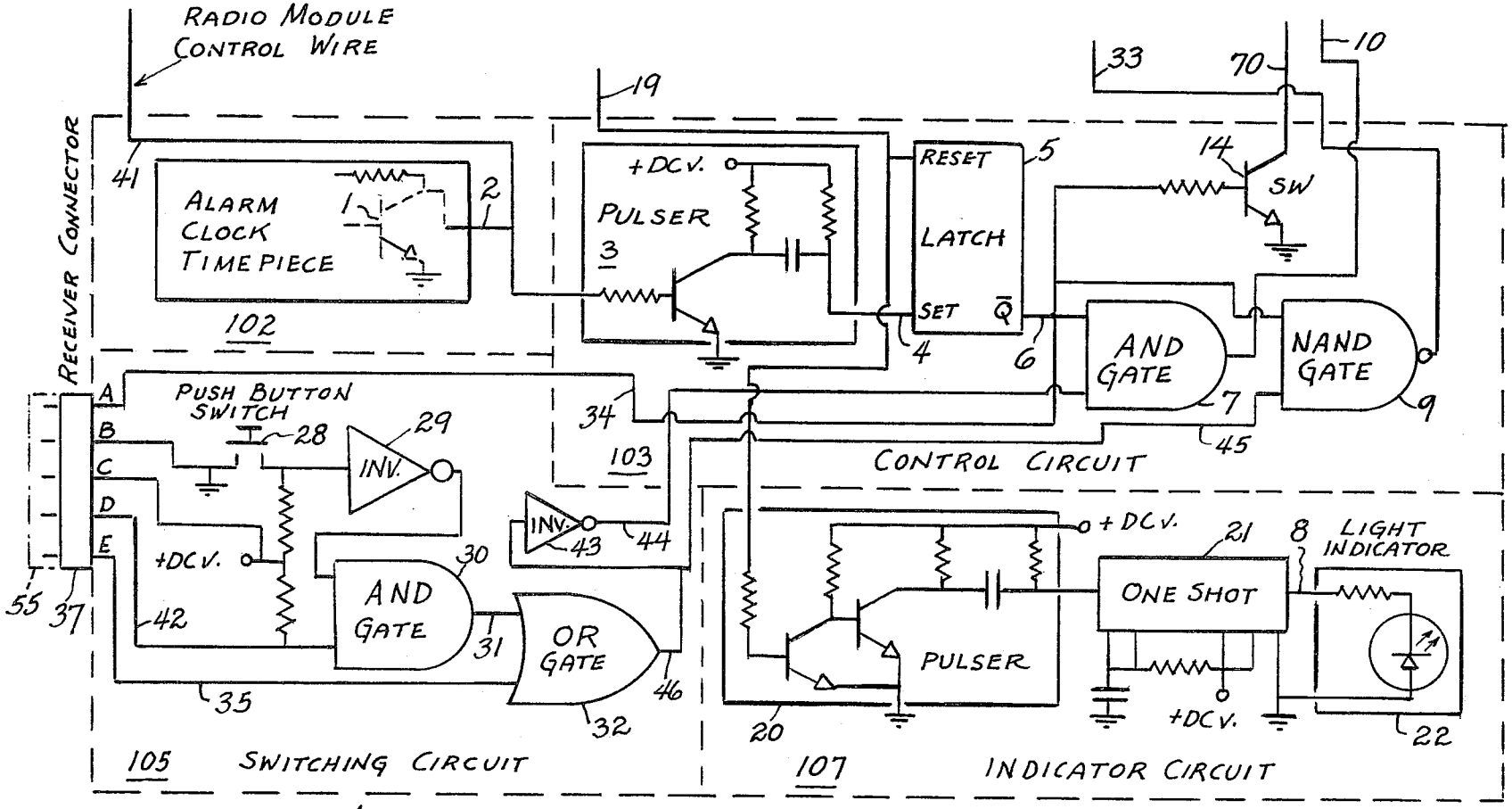
FIG. 2B is a detailed wiring diagram showing the alarm clock timepiece, the control circuit, and the switching circuit and the indicator segments of the system of FIG. 1.

Referring to FIGS. 2A and 2B, clock module 101 is provided with a conventional power supply 108 which is energized from a convenient nearby 115 volt A.C. power source via connector 36. The power supply circuit converts the energizing A.C. voltage to a regulated positive direct current (+D.C.v.) for the operation of all the circuits.

The alarm clock timepiece 102 is a conventional timepiece which can be adjusted by the user to activate an alarm switch at a selected time. At the selected time, the output of transistor alarm switch 1 of the alarm clock timepiece 102 switches to a high logic level ("H" logic level). The "H" logic level is applied on line 2 feeding pulser 3. The output pulse on line 4 from pulser 3 sets latch 5, changing its $\overline{Q}$ terminal to the "H" level output, which is applied to line 6. The "H" level on line 6 activates AND gate 7 which applies a "H" logic level on line 10. AND gate 7 is already in an enabled state because a "H" logic level furnished by an inverter 43 on line 44 is applied to the other input of AND gate 7. It is to be noted that an AND gate can be activated when one of its inputs is at the "H" level. Further, if either input of the AND gate is held at the "L" level the AND gate is disabled. The "H" level on line 10 is fed to switching transistor 11 which turns on tone oscillator 12, causing alarm speaker 13 to emit an audible tone. Line 6 branches to two other devices, namely, an input of NAND gate 9 and the input of transistor switch 14. Line 6 also branches to line 34 which is connected to terminal A of receiver connector 37. The latter branch will be discussed later when receiver module 109 is described. The "H" level on line 6 branching to one input of NAND gate 9 sets this gate in an enabled state. In an enabled state, NAND gate 9 can now be activated by commands from switch circuit 105. Before the start of an alarm cycle any command from switch circuit 105 which may result from accidentally depressing push button switch 28, in the local control setting, is inhibited by NAND gate 9. The "H" level on line 6 branching to transistor switch 14 turns this device on, causing solenoid 15 to be activated via line 70. As shown in FIG. 2A, solenoid 15 is part of timing circuit 106. When solenoid 15 is activated, it decouples shaft 16, disengaging dial 18 so that it cannot turn selector switch 17. Consequently, the user of the clock cannot change the preset turn-off time until a new alarm cycle is started. This completes a description of the circuit functions which put an alarm cycle in progress. The circuit functions which turn off an alarm cycle will next be described.

Assuming the user of the clock holds push button switch 28 of switching circuit 105 in a depressed state, a "L" logic level will be applied to the input of inverter 29. Inverter 29 feeds a "H" logic level to the input of AND gate 30. And gate 30, being held in an enabled state by a "H" logic level on its other input, will be activated and will feed a "H" logic level via line 31 to one input of OR gate 32. The output of OR gate 32 feeds a "H" logic level to line 46, which branches to the input of an inverter 43 and to line 45 feeding one input of NAND gate 9. The "H" logic level fed on line 46 to the input of inverter 43 causes said inverter to apply a "L" level to line 44 feeding one input of AND gate 7. The "L" level input to AND gate 7 disables the device, interrupting the "H" level that turned on gated alarm circuit 104 and likewise the audible alarm signal. The "H" logic level applied to one input of NAND gate 9 from line 45 causes it to apply a "L" logic signal to line 33. The "L" level on line 33 is fed to the input of transistor switch 23 and to the $R_1$ terminal of counter 26. The "L" level input to the $R_1$ terminal of binary counter 26 sets this device in the count mode of operation and it will start counting each pulse fed on line 25 to its input terminal. The "L" level input to transistor switch 23 disables this device, causing its output to go to the "H" level, which activates timing generator 24. In an activated state, timing generator 24 emits a pulse every second on line 25, which in turn causes 4-bit binary counter 26 to furnish a binary code on lines A, B, C and D feeding 4-line-to-16-line decoder 27. Line decoder 27 decodes the binary input, and for each pulse on line 25 progressively shifts one output line to a "L" logic level while all of the others remain at the "H" level. This progression starts with output line (a) and moves toward line (p). Line (a) is open-circuited and represents a zero time reference since it goes to the "L" level instantly after push button 28 is depressed. One second after line (a) is at the "L" level line (b) will become the next line at the "L" level. It follows then that 10 seconds after line (a) is at the "L" level line (k) will be the only line at the "L" level. It is assumed that dial 18 of timing circuit 106 was set at 10 seconds by the user of the clock. Consequently, through the rotating arm of switch 17 which engages the contact connected to line (k) the "L" logic level is conducted to line 19. The "L" level on line 19 is fed to the reset terminal of latch 5, which instantly resets the $\overline{Q}$ terminal output to the standby state. Likewise, all subordinate circuits controlled by latch 5 are reset to their standby state to await the next alarm time. Concurrently with resetting latch 5, the "L" logic level on line 19 branches to the input of pulser 20 of indicator circuit 107. The output of pulser 20 activates one-shot 21, which produces a "H" logic level output on line 8 for a period of five seconds. The "H" level on line 8 turns on light indicator 22 for a period of five seconds. The energization of the light indicator 22 serves to alert the user that the alarm cycle has terminated and that push button switch 28 can be released.

The above description covered a situation wherein the user held the push button switch 28 in a depressed state for the total time period set on dial 18. For those instances in which the user releases push button switch 28 before the preset time period, the logic functions of switching circuit 105 are reversed and likewise that of AND gate 7 of control circuit 103. Under the latter condition of the gates the audible alarm resumes operation, binary counter 26 is reset, and timing generator 24 is turned off. A new turn-off cycle beginning at zero time will commence when the user again depresses push button switch 28. The above alarm cycle turn-off interruption may be repeated until the user has awakened sufficiently to hold push button switch 28 depressed for the full duration of the time initially preset on dial 18.

Another form of the present invention provides for the remote capability for turning off an alarm cycle of clock module 101 of FIG. 2B. The receiver module 109 (FIG. 2C) and transmitter module 111 (FIG. 3) are part of this form of the invention. However, the receiver unit 61 in FIG. 2C and the transmitter unit 80 in FIG. 3, which are used in the respective modules 109 and 111, are in themselves of a conventional design such as are employed for the remote control of such devices as garage door openers, model airplanes, boats, and the like, and will not here be described in detail. The receiver and transmitter modules 109 and 111 provide the user with the option of using push button switch 28 to turn off an alarm cycle locally, or alternatively, to duplicate its function from a remote location. A detailed description will now be given of the circuits providing this remote control capability.

Figure 2C:
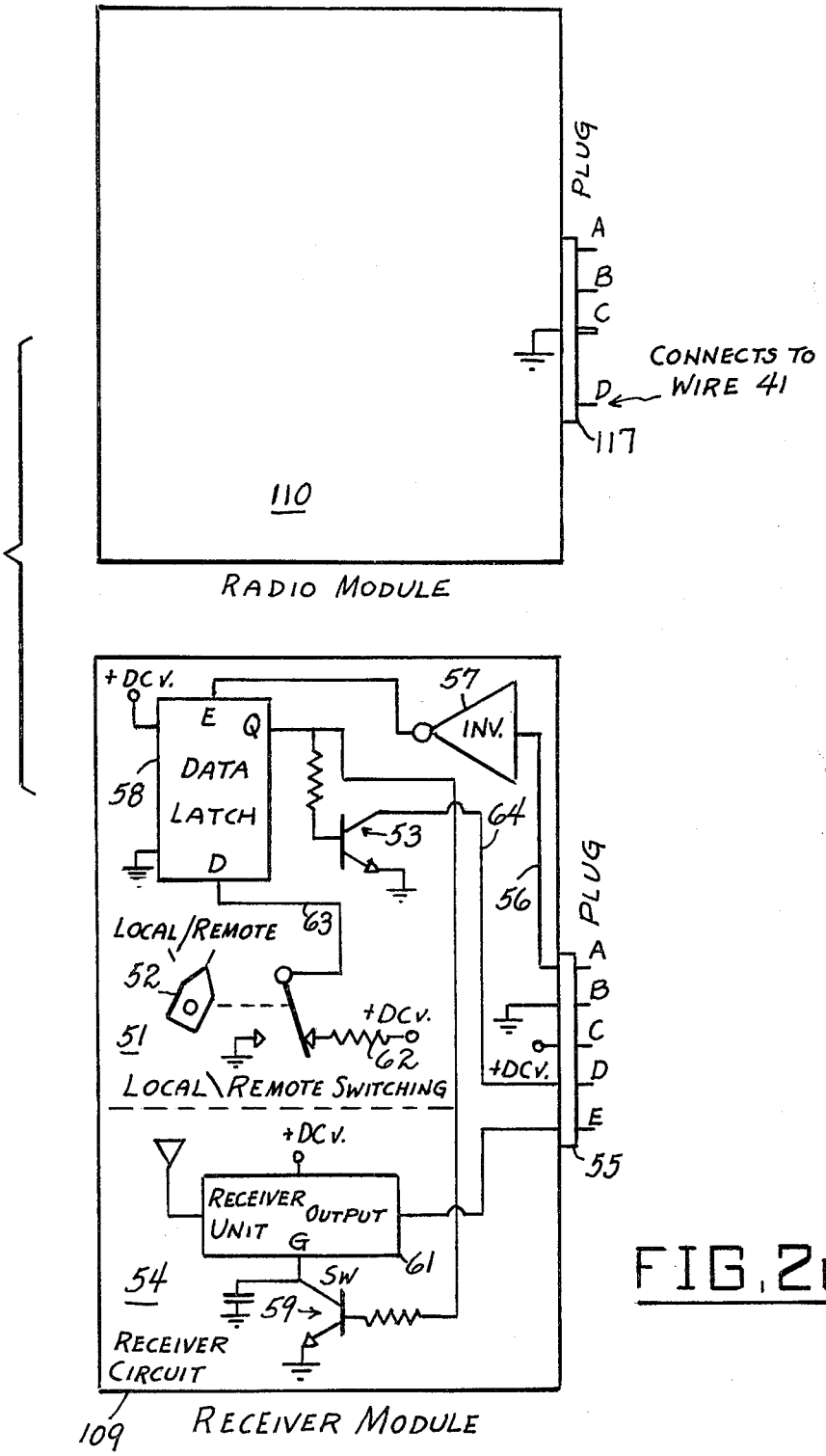
FIG. 2C is a wiring diagram showing the standard broadcast radio and the receiver module segments of the system of FIG. 1.

Referring to FIG. 2C, connector plug 55 of receiver module 109 mates with receiver connector 37 of clock module 101 of FIG. 2B. The positive direct current voltage (+D.C.v.) required to operate the receiver module is furnished through pin "C" of connector 37 by the power supply circuit 108. The receiver module is enabled concurrently with the start of an alarm cycle. The "H" logic level at the $\overline{Q}$ terminal of latch 5 which is fed on line 6 branches to line 34, which connects to terminal A of receiver connector 37. The "H" level signal on line 34 continues through the mated connectors 37, 55 and is picked up on line 56 leading to the input of inverter 57 in receiver module 109. The output of inverter 57 feeds a "L" logic level to terminal "E" of data latch 58, causing the data latch to store on the Q output thereof whatever logic level was last present at the "D" terminal of the data latch 58. Conversely, if an alarm cycle is off, the "E" terminal of the data latch will be at the "H" logic level, and the Q output follows the logic level changes fed by switch 52 to the "D" terminal of data latch 58. Switch 52 is a two-position switch having a "local" and a "remote" position. When switch 52 is in the local position, a "L" logic level is fed to the "D" terminal, and in the remote position a "H" logic level is fed to said "D" terminal. In describing the remote control capability it is assumed that selector switch 52 was set in the remote position prior to the start of an alarm cycle. Therefore, the "D" terminal will be at an equivalent "H" logic level by reason of the +D.C.v. level applied to resistor 62. The +D.C.v. level applied to resistor 62 passes through the contacts of local/remote selector switch 52 on to line 63 and thence to the "D" terminal of data switch 58. The "Q" output is latched at the "H" level. The "H" level at the "Q" output is fed to the inputs of transistors 53 and 59. The output of transistor switch 59 enables receiver unit 61. The output of transistor 53 feeds a "L" logic level on line 64 by pulling the "G" terminal (ground terminal) down to ground level. The "L" level on line 64 passes through plug connector 55 and mating receiver connector 37 on to line 42 (FIG. 2B). The "L" level on line 42 feeds on input of AND gate 30, causing it to become disabled and isolate the control of push button switch 28. Now when transmitter module 111 sends a continuous signal to receiver circuit 109, a "H" logic level from its output is fed to terminal "E" of plug connector 55. The "H" level on terminal "E" passes through the receiver connector 37 to line 35. The "H" level on line 35 is fed to to one input of OR gate 32. This causes OR gate 32 to function identically as when gated by a "H" logic level on line 31 resulting from the use of push button switch 28. It is thus apparent that the remote control function can substitute for the function of local push button switch 28. The operation of transmitter module 111 will now be described.

Figure 3:
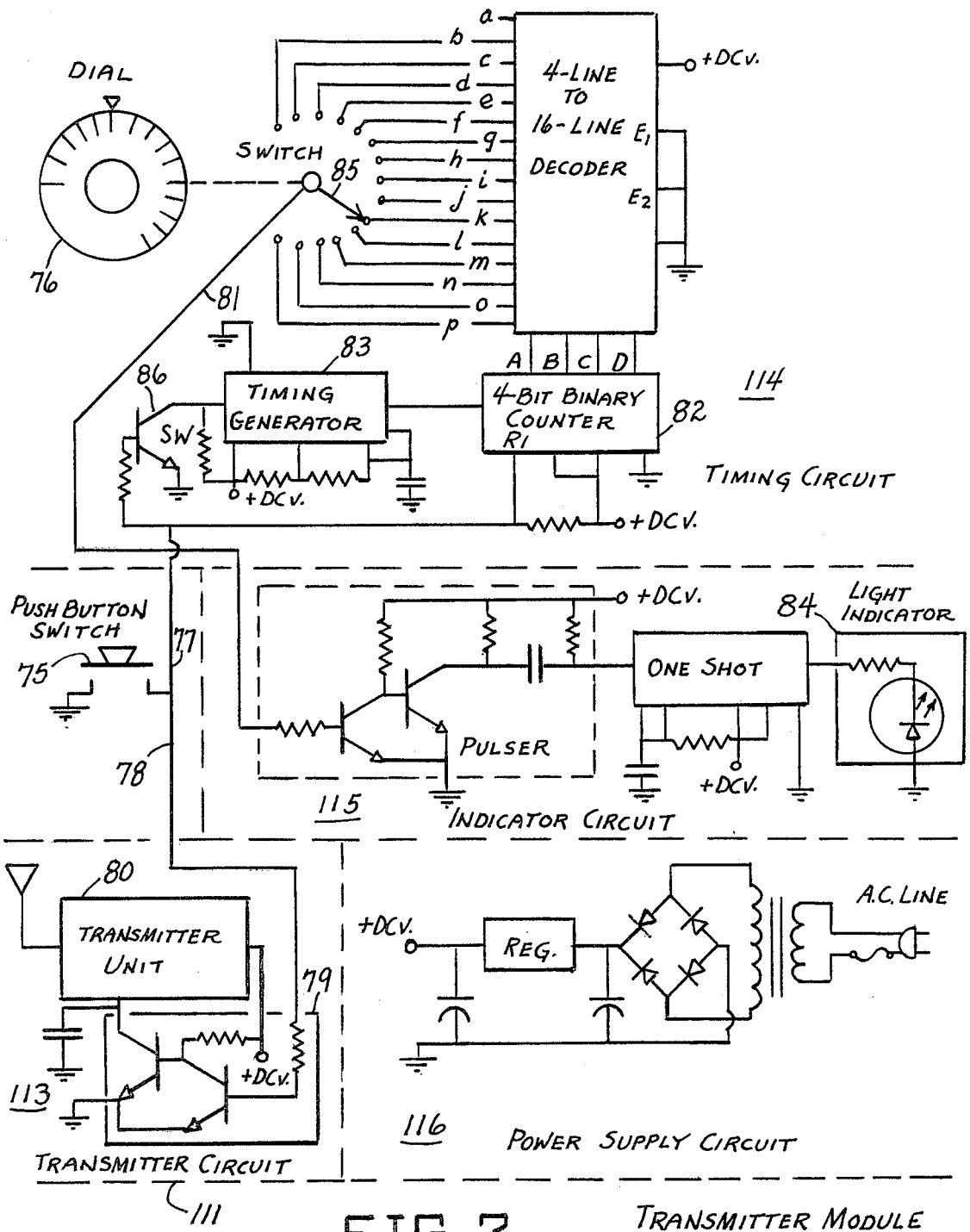
FIG. 3 is a wiring diagram showing the transmitter module of the system of FIG. 1.

FIG. 3 is a diagram of transmitter module 111. Timing circuit 114 and indicator circuit 115 are identical to the circuits having the same titles and numbered 106 and 107 respectively in clock module 101. These two circuits are only required in the transmitter module to alert the user that push button switch 75 has been depressed sufficiently long to turn off the clock module alarm cycle. Of course, dial 76 must be preset to the same turn-off time period set on dial 18 of switch timing circuit 106. Assuming that dials 18 and 76 are set to number 10 (10 seconds), remote-local switch 52 is set to the remote position, and along comes an alarm cycle, the clock user must use push button switch 75 on the remotely located transmitter module 111 to interrupt the audible alarm and terminate the alarm cycle. When the user holds push button switch 75 in a depressed state, lines 77 and 78 are set at a "L" logic level. The "L" level on line 78 is fed to the input of transistor switch 79. Transistor switch 79 turns on transmitter unit 80, causing it to send a continuous signal to receiver unit 61 of receiver module 109. The receiver unit detects the transmitted signal and provides a "H" logic level at its output. The "H" level at the receiver unit's output sets in action the clock module 101 circuits previously described for terminating an alarm cycle. Concurrently with the start of this function, the "L" logic level on line 77 branches to transistor switch 86 and to the $R_1$ terminal of binary counter 82 of timing circuit 114. Timing circuit 114 functions identically to timing circuit 106 which was previously described for clock module 101, with one exception. Timing generator 83 is adjusted so that the time between pulses is incrementally longer than the one second time interval between pulses at the output of its counterpart. This longer time interval is to compensate for any incremental circuit delay time and transmission tolerances. Further, since this incremental time difference is so short, the user will be unaware that he held push button switch 75 slightly longer than the 10 seconds before indicator circuit 115 became activated. Indicated circuit 115 functions identically to its counterpart, indicator circuit 107, previously described under the operation of clock module 101. All of the circuits in transmitter module 111 are operated by power supply circuit 116. The power supply circuit 116 is energized and operates in a manner equivalent to that of power supply circuit 108 employed in clock module 101.

Referring to FIG. 2C, radio module 110 forms part of an embodiment of the present invention providing a composite clock/radio. Since the radio module contains a conventional AM or AM/FM radio circuit, details of the circuit design will not be described. However, the radio module does contain added circuits which interface with circuits in clock module 101 (FIG. 2A). When the radio module plug connector 117 is mated with radio connector 38 of clock module 101, it receives electrical power via the connector elements "A" and "B" of the mating connectors 117,38, to operate all of its circuits, the electrical energy being supplied via lines 119,120, respectively of FIG. 2A, connected to supply wires 39, 40. The radio module has a panel switch which permits the user to independently turn on the radio. This panel switch is also provided with an automatic setting which permits the radio to be turned on by an alarm signal from the circuit in alarm clock timepiece 102 of clock module 101. As previously described, the alarm clock timepiece 102 (FIG. 2B), at a preset time feeds a "H" logic level on line 2. The "H" logic level on line 2 branches to line 41, feeding terminal "D" of connector 38. Consequently, this "H" logic level passes through connector 117 on pin "D" into the radio module and activates the radio automatic turn-on circuit. The automatic turn-on circuit permits the radio to continually operate until the panel switch on the radio module is turned to the off position.

Figure 4:
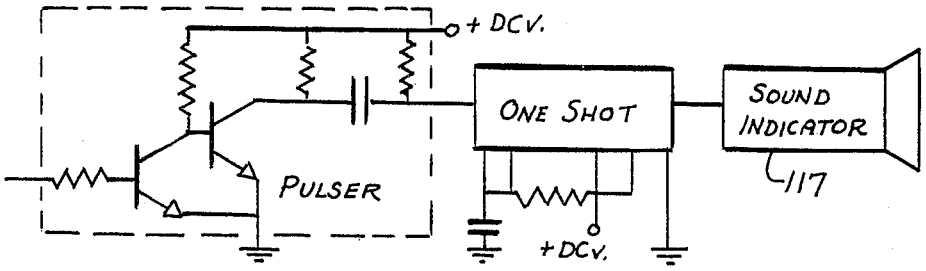
FIG. 4 is a detailed wiring diagram of a sound indicator circuit which can be used in the clock module and transmitter of FIG. 1 in place of the light indicator circuits shown in FIGS. 2B and 3, in accordance with the present invention.
Figure 5:
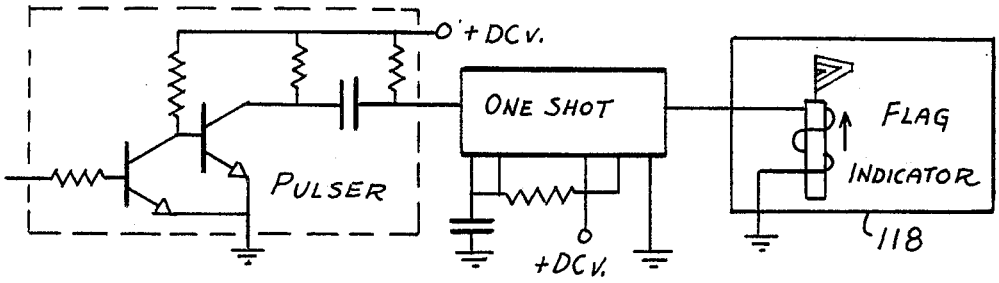
FIG. 5 is a detailed wiring diagram of a flag indicator circuit which can be used in the clock module and transmitter of FIG. 1 in place of the light indicator circuits shown in FIGS. 2B and 3, in accordance with the present invention.

FIGS. 4 and 5 show two indicator circuits which are substantially identical to the indicator circuits 107 and 115 except for the specific indicating elements. Instead of using luminous visible indicating elements 22 and 84, either an audible sounding indicator 117 of FIG. 4 or a flag indicator 118 of FIG. 5 may be substituted as a means for alerting the user that an alarm cycle has been completed, namely, completion of the required hold-down period has been accomplished.

Although the specific embodiment of the invention described above employs remote control of the alarm by the use of a remote-control coupling means comprising a radio transmitter at the remote station and a radio receiver at the alarm clock location, other known methods and means for transmitting control signals from a remote station to a local station may be employed within the spirit of the present invention, such as (a) by sonic signals which are emitted by the remote station component, transmitted through the air, and detected by microphone means at the clock component, (b) by electrical impulses which are generated by the remote station component and channeled through the electrical wiring system of the building structure via the electrical wall outlets into which the components are plugged, or (c) by optical light wave frequencies which are channeled through fiber optic cables from the remote component to the clock component, as typical examples of suitable remote-control coupling means.

While a specific embodiment of an improved alarm clock system has been disclosed in the foregoing description, it will be understood that various modifications within the scope of the invention may occur to those skilled in the art. Therefore, it is intended that adaptations and modifications should and are intended to be comprehended within the meaning and range of equivalents of the disclosed embodiment.

What is claimed is:

1. An alarm clock system comprising an alarm clock timepiece including alarm starting means for producing an electrical alarm signal, means to generate an audible alarm responsive to said electrical alarm signal, manually operated deactivation switch means, circuit means to deactivate said audible alarm generating means immediately upon manual operation of said deactivation switch means, means to completely deactivate said audible alarm generating means responsive to continuous manual operation of said deactivation switch means for a predetermined extended period of time, indicator means, and means to activate said indicator means upon completion of and responsive to the continuous manual operation of said deactivation switch means for said predetermined extended period of time.

2. The alarm clock system of claim 1, and wherein said deactivation switch means is located at a remote location relative to said alarm clock timepiece, whereby the user must travel to said remote location in order to manually operate said deactivation switch means.

3. The alarm clock system of claim 1, and wherein said alarm clock system includes remote-control coupling means between said deactivation switch means and said audible alarm-generating means.

4. The alarm clock system of claim 3, and wherein said coupling means is normally disabled, and means to enable said coupling means responsive to said electrical alarm signal.

5. The alarm clock system of claim 3, and wherein said remote-control coupling means comprises a radio link.

6. The alarm clock system of claim 1, and wherein said indicator means comprises a normally deactivated visual indicator.

7. The alarm clock system of claim 1, and wherein said deactivation switch means is located at a remote location relative to said alarm clock timepiece, and wherein said indicator means is located adjacent to said deactivation switch means.

8. The alarm clock system of claim 7, and wherein said system includes remote-control coupling means comprising a radio frequency deactivation signal transmitter at said remote location and a radio receiver adjacent to said alarm clock timepiece in coupling relation with said transmitter, means to enable said coupling means responsive to said electrical alarm signal, means to activate said transmitter responsive to operation of said deactivation switch means, and means to deactivate said audible alarm generating means responsive to a radio signal from said transmitter received by said radio receiver.

9. The alarm clock system of claim 1, and additional manually operated deactivation switch means located at a remote location relative to said alarm clock timepiece, additional indicator means at said remote location, remote-control coupling means between said additional manually operated switch means and said audible alarm-generating means, means including said coupling means to at times deactivate said audible alarm-generating means immediately responsive to manual operation of said additional switch means, means to at said times completely deactivate said audible alarm-generating means responsive to continuous operation of said additional switch means for another predetermined extended period of time, and means to activate said additional indicator means responsive to the completion of said second-named extended period of continuous manual switch means operation.

10. The alarm clock system of claim 9, and wherein said second-named predetermined extended period of time is slightly longer than said first-named extended period of time to compensate for incremental circuit delay time and transmission tolerances.

11. The alarm clock system of claim 9, and selector switch means to selectively place said audible alarm-generating means under the control of either said first-named manually operated deactivation switch means or of said second-named manually operated deactivation switch means.

12. The alarm clock system of claim 11, and respective manually adjustable variable time control means to adjust the period of continuous manual operation of the first-named and the additional manually operated switch means required to completely deactivate the alarm-generating means.

13. The alarm clock system of claim 11, and means to reactivate said audible alarm-generating means and resume said audible alarm if the selected manually operated deactivation switch means is released prior to the expiration of the required predetermined extended time period of operation.

14. The alarm clock system of claim 11, and wherein said means to deactivate the alarm-generating means includes respective preset time counters associated with the first-named and the additional manually operated switch means, means to energize the counter associated with the selected manually operated switch means responsive to operation of said selected manually operated switch means, and means to automatically reset the associated counter to a zero position if the selected manually operated switch means is released prior to the expiration of the time preset on said associated counter.

15. The alarm clock system of claim 1, and means to reactivate said audible alarm-generating means and resume said audible alarm if said deactivation switch means is released prior to the expiration of said predetermined extended period of time.

16. The alarm clock system of claim 1, and wherein said means to activate said indicator means includes means to maintain said indicator means energized for a predetermined interval of time subsequent to becoming activated.

17. The alarm clock system of claim 1, and wherein said means to activate said indicator means responsive to said continuous manual operation of the deactivation switch means includes manually adjustable variable time control means to adjust the required period of continuous manual operation to completely deactivate said alarm-generating means.

18. The alarm clock system of claim 1, and wherein said means to deactivate the alarm-generating means includes a preset time counter, means to energize said counter responsive to operation of said deactivation switch means, and means to automatically reset the counter to a zero position if the deactivation switch means is released prior to the expiration of the time preset on the counter.

19. The alarm clock system of claim 1, and additional manually operated deactivation switch means located at a remote location relative to said alarm clock timepiece, additional indicator means at said remote location, remote-control coupling means between said additional manually operated switch means and said audible alarm-generating means, means including said coupling means to at times deactivate said audible alarm-generating means immediately responsive to manual operation of said additional switch means, means to at said times completely deactivate said audible alarm-generating means responsive to continuous operation of said additional switch means for another predetermined extended period of time, and means to activate said additional indicator means responsive to the completion of said second-named extended period of continuous manual switch means operation, wherein said remote-control coupling means is normally disabled, and means to enable said remote-control coupling means responsive to the operation of said additional switch means at said remote location.

20. The alarm clock system of claim 19, and selector switch means to selectively place said audible alarm-generating means under the control of either said first-named manually operated deactivation switch means or of said additional manually operated deactivation switch means, and means to inhibit activation of said remote-control coupling means responsive to selection of said first-named manually operated deactivation switch means.

21. The alarm clock system of claim 20, and means to inhibit deactivation of said audible alarm-generating means by said first-named manually operated deactivation switch means responsive to selection of said additional manually operated deactivation switch means.

22. The alarm clock system of claim 20, and wherein said selector switch means and the local portion of said remote-control coupling means are in the form of a module detachably connected to said alarm clock timepiece and which can be detached for alarm deactivation control solely by said first-named manually operated deactivation switch means.

23. The alarm clock system of claim 1, and a standard broadcast radio receiver module detachably connected to said alarm clock timepiece and having a control terminal, and circuit means connecting said electrical alarm signal to said control terminal.

* * * * *